US006406304B1

(12) United States Patent
Kuo

(10) Patent No.: US 6,406,304 B1
(45) Date of Patent: Jun. 18, 2002

(54) CARD CONNECTOR WITH AN IMPROVED REINFORCING BEAM

(75) Inventor: Ming-Lun Kuo, Tu-Chen (TW)

(73) Assignee: Hon Hai Precision Ind Co., Ltd., Taipei Hsien (TW)

( * ) Notice: Subject to any disclaimer, the term of this patent is extended or adjusted under 35 U.S.C. 154(b) by 0 days.

(21) Appl. No.: 09/788,090

(22) Filed: Feb. 16, 2001

(51) Int. Cl.[7] ..... H01R 9/09
(52) U.S. Cl. ..... 439/64
(58) Field of Search ..... 439/64, 377, 607; 361/2

(56) References Cited

U.S. PATENT DOCUMENTS 5,725,394 A * 3/1998 Banakis ..... 439/607
6,236,547 B1 * 5/2001 Han ..... 439/607

* cited by examiner

*Primary Examiner*—Tulsidas Patel
*Assistant Examiner*—P K T Dinh
(74) *Attorney, Agent, or Firm*—Wei Te Chung

(57) ABSTRACT

A card connector (2) comprises a header connector (20),two arms (21) extending forwardly from lateral edges of the header connector and a reinforcing beam (22) being integral with the arms. Each of the arms defines a guiding groove (210) and an upper flange (211) above the groove. The reinforcing beam is configured to have a front edge (221) with a flat middle portion (222) and two side portions (223) beside the middle portion. The side portions incline forwardly and sidewardly from the middle portion toward the guiding arms to connect with the upper flanges of the guiding arms, respectively. The reinforcing beam has a thickness smaller than that of the upper flange.

7 Claims, 4 Drawing Sheets

CARD CONNECTOR WITH AN IMPROVED REINFORCING BEAM

BACKGROUND OF THE INVENTION

1. Field of the Invention

The present invention is related to a card connector, and particularly to a card connector with a reinforcing beam reinforcing guiding arms of the card connector.

2. Description of the Related Art

Referring to FIGS. 3 and 4 of the present application, a conventional card connector 1 comprises a header connector 11 and two guiding arms 12 extending forwardly from two lateral sides of the header connector 11. The header connector 11 receives a plurality of terminals 13 therein each of which has an end 131 extending beyond a mating face 14 of the header connector 11 for engaging with an electronic card (not shown) and an opposite end 132 for being soldered to a printed circuit board (not shown). A reinforcing beam 15 is formed in front of the header connector 11 and integrally connects both guiding arms 12 thereby reinforcing a free end portion of the guiding arms 12 to prevent them from deformation during molding of the plastic frame of the card connector 1.

The reinforcing beam 15 is relatively thin when subject to heat, for example, the heat for soldering the connector 1 to the printed circuit board, is easily to deform to a condition as shown in FIG. 4, having a downward curved configuration with a lowest point about a middle portion of the beam 15 (as shown by phantom lines of FIG. 4). The deformed beam 15 will obstruct the electrical card from completely entering the card connector 1 to have an electrical connection therewith.

An option to solve this problem is to increase the thickness of the reinforcing beam. However such option cannot meet the compact trend and requirement of electrical component.

Hence, an improved card connector is needed to overcome the disadvantages of the prior art.

BRIEF SUMMARY OF THE INVENTION

An object of the present invention is to provide a card connector with an reinforcing beam which will not deform, due to heat, to obstruct a card from completely entering the card connector.

To achieve the above-mentioned object, a card connector comprises a header connector, a plurality of terminals received in the header connector, two arms extending forwardly from lateral edges of the head connector and an reinforcing beam being located in front of the header connector and integral with the arms. There is a distance between the header connector and the reinforcing beam. Each of the arms defines a guiding groove for guiding a card inserted into the card connector and has an upper flange above the guiding groove. The reinforcing beam is configured to have a front edge with a flat middle portion and two side portions beside the middle portion. Each side portion inclines forwardly and sidewardly from the middle portion toward the guiding arms 21 to connect with the upper flange of a guiding arm. The reinforcing beam has a thickness smaller than that of corresponding guiding arm.

Other objects, advantages and novel features of the invention will become more apparent from the following detailed description of the preferred embodiment when taken in conjunction with the accompanying drawings.

DETAILED DESCRIPTION OF THE INVENTION

Figure 1:
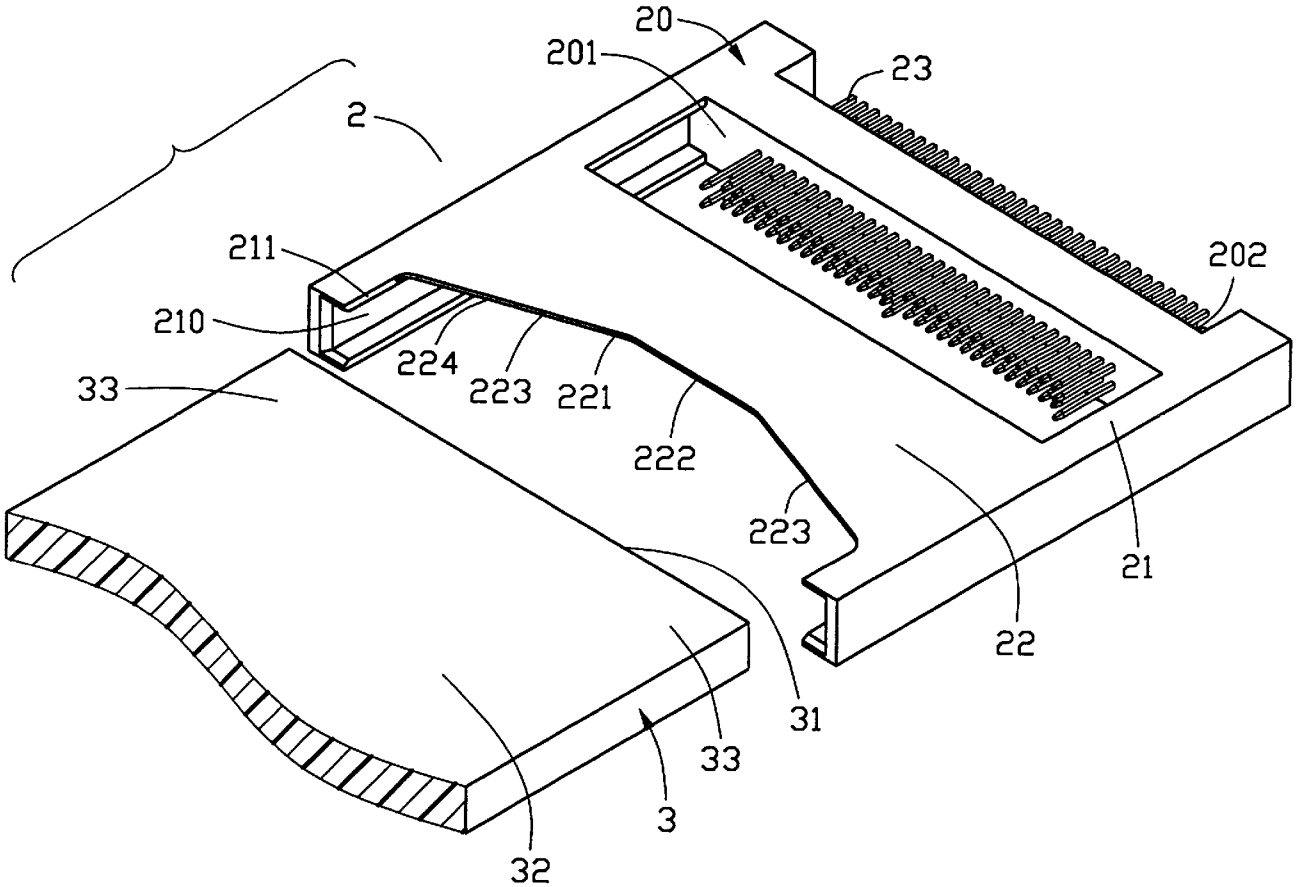
FIG. 1 is a perspective view of a card connector in accordance with the present invention and a card to be inserted into the card connector.

Referring to FIG. 1, a card connector 2 includes a header connector 20 with a mating face 201 and an opposite mounting face 202, two guiding arms 21 extending forwardly from two lateral ends of the header connector 20, and a reinforcing beam 22 located between and connecting front portions of the guiding arms 21. The guiding arms 21, the reinforcing beam 22 and a housing of the header connector 20 are integrally formed by plastic injection molding. A plurality of terminals 23 are received in the housing of the header connector 20 with one end (not labeled) of each terminal 23 extending beyond the mating face 201 of the header connector 20 and another end (not labeled) of each terminal 23 extending beyond the mounting face 202 of the header connector 20 for being soldered to a printed circuit board (not shown). Each of the arms 21 has a guiding groove 210 to guide a card 3 inserted into the card connector 2. Each guiding arm 21 has an upper flange 211 above the guiding groove 210.

The reinforcing beam 22 is integral with the arms 21. There is a distance between the header connector 20 and the reinforcing beam 22. The reinforcing beam 22 is configured to have a front edge 221 with a flat middle portion 222 and two side portions 223 beside the middle portion 222. The side portions 223 incline forwardly and sidewardly from the middle portion 222 toward the guiding arms 21 to connect with the upper flanges 211 of the guiding arms 21, respectively. The reinforcing beam 22 has a thickness smaller than that of the upper flange 211. That is, the side portions 223 of the reinforcing beam 22 connect with only an upper part of the upper flange 211 of the guiding arms 21 so that bottom faces of the inner ends of the side portions 223 are not lower than the bottom face of the upper flange 211.

Figure 2:
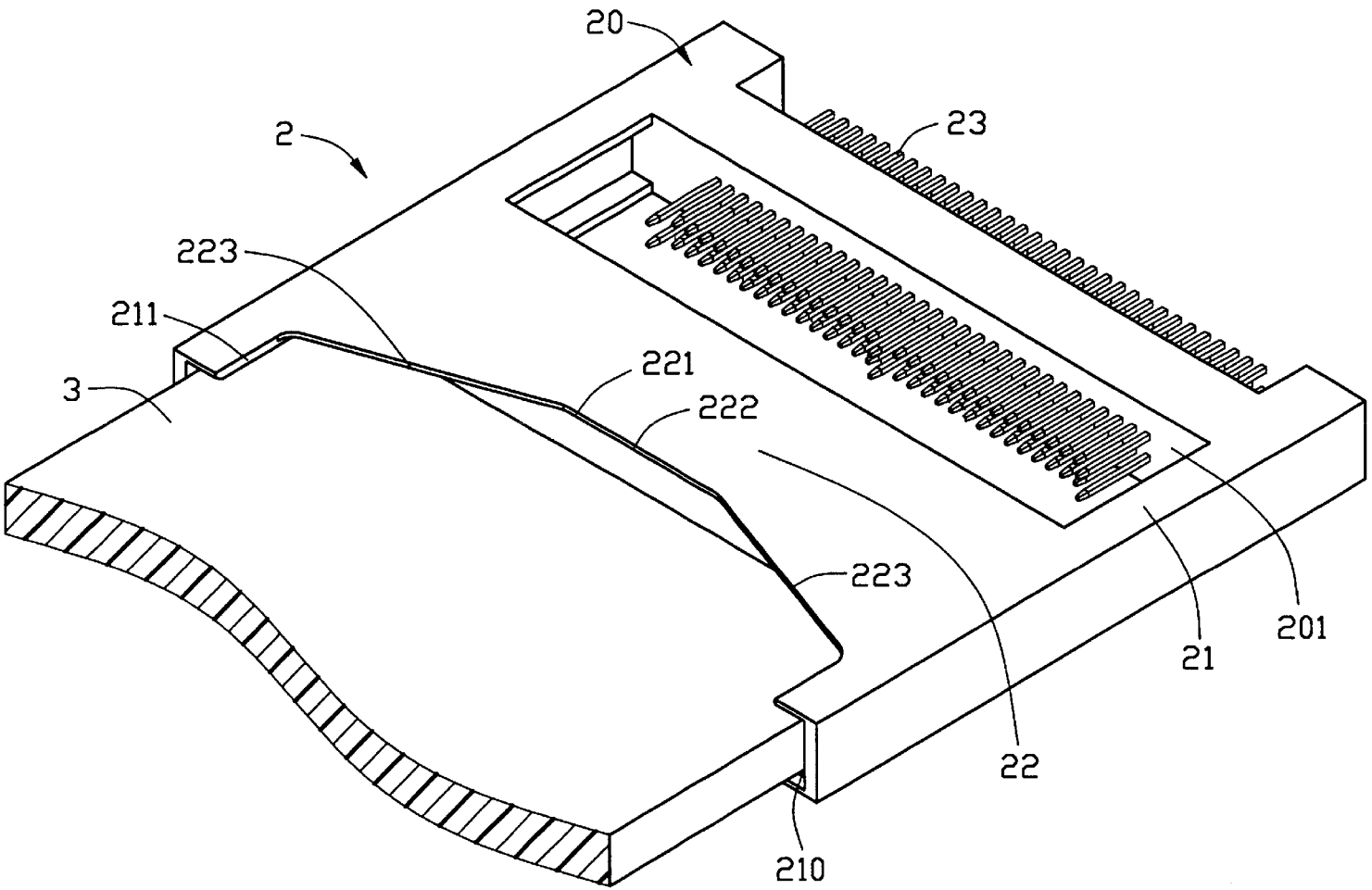
FIG. 2 is a perspective view showing the card being inserted in the card connector of FIG. 1.
Figure 3:
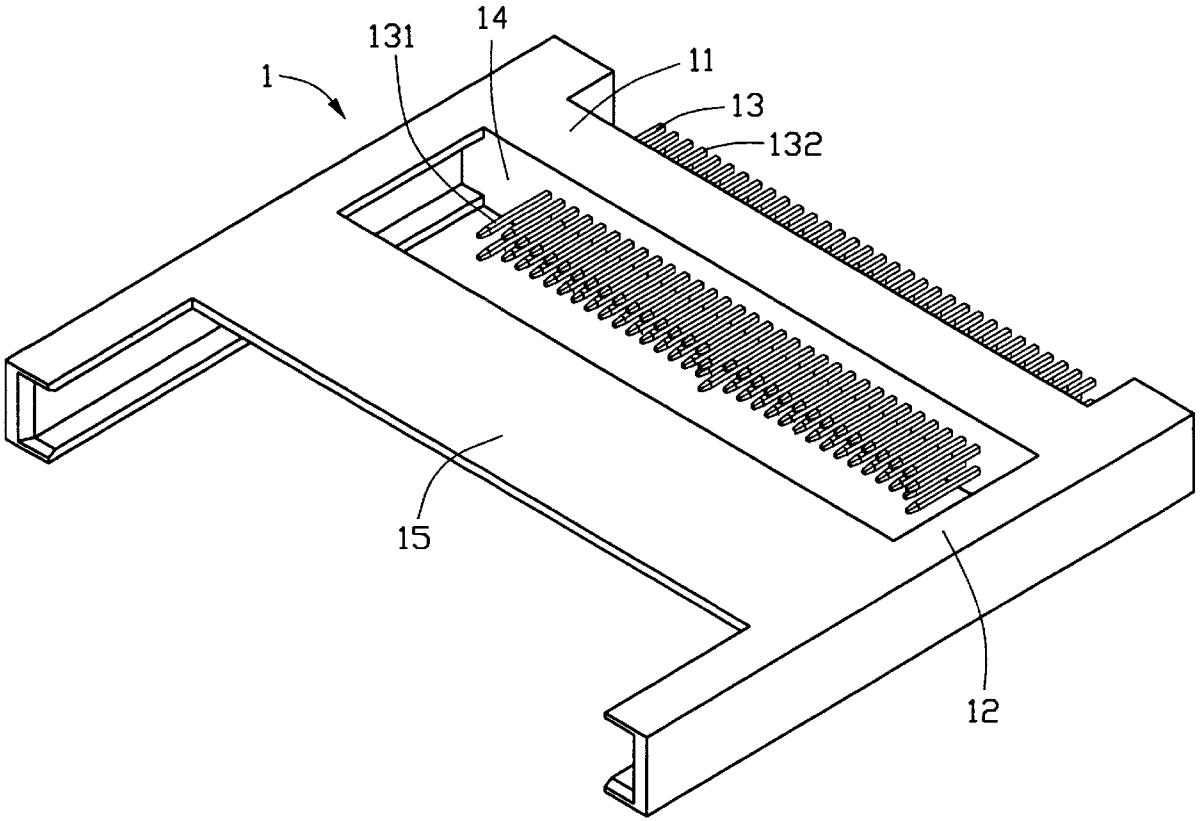
FIG. 3 (PRIOR ART)
FIG. 3 is a perspective view of a conventional card connector.
Figure 4:
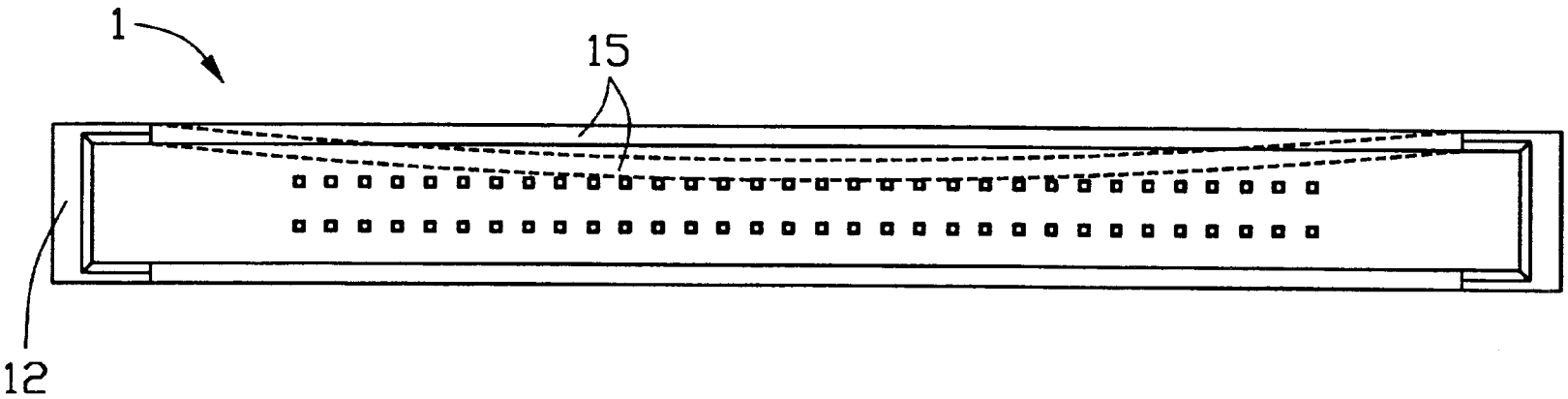
FIG. 4 (PRIOR ART)
FIG. 4 is a front view of the conventional card connector.

Also referring to FIG. 2, when the card connector 2 is soldered to the printed circuit board so that the reinforcing beam 22 is deformed to have a downwardly curved configuration as that of the reinforcing beam 15 of the prior art of FIG. 4, and a card 3 is inserted into the connector 2 by having two lateral sides of the card 3 moving rearwardly in the guiding grooves 210, since a rear edge 31 of the card 3 first confronts the inclined side portions 223 of the front edge 221 of the reinforcing beam 22 which are deviated from their original level a small distance, the card 3 can be inserted into the connector 2 with two rear corners 33 of the card 3 being located below two lateral sides of a front portion of the reinforcing beam 22. Further insertion of the card 3 causes a top face 32 of the card 3 to abut against a bottom face 224 of the reinforcing beam 22 to upwardly push the largely fallen middle portion 222 of the reinforcing beam 22. Thus, the middle portion 222 of the reinforcing beam 22 no longer obstructs the insertion of the card 3 and the card 3 can be wholly extended through the reinforcing beam 22 to electrically engage with the terminals 23.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card connector comprising:

a header connector comprising a mating face and a mounting face opposite the mating face, a plurality of terminals received in the header connector, each terminal having a first end extending forwardly beyond the mating face for engaging with an electronic card and a second end extending beyond the mounting face;

two guiding arms extending forwardly from two lateral edges of the header connector, each of the arms defining a guiding groove; and a reinforcing beam integrally formed between the two guiding arms and spaced from the header connector; wherein the reinforcing beam has a front edge on the top with a flat middle portion and two side portions extending forwardly and laterally from the middle portion to connect with the guiding arms, respectively.

2. The card connector as claimed in claim 1, wherein each of the guiding arms has an upper flange above the guiding groove thereof, the reinforcing beam connecting with the upper flanges of the guiding arms.

3. The card connector as claimed in claim 2, wherein the reinforcing beam has a thickness smaller than that of the upper flanges of the guiding arms.

4. A card connector comprising:

a header connector comprising a mating face and a mounting face opposite the mating face, a plurality of terminals received in the header connector, each terminal having a first end extending forwardly beyond the mating face for engaging with an electronic card and a second end extending beyond the mounting face;

two guiding arms extending forwardly from two lateral edges of the header connector, each of the arms defining an upper flange with a guiding groove thereunder, a width of the upper flange of each of said guiding arms measured in a transverse direction being smaller than a height of said each of the guiding arms measured in a vertical direction; and a reinforcing beam integrally formed between the two guiding arms and in front of the header connector; wherein the reinforcing beam has a front edge with a middle portion and two side portions connected to the upper flanges of the corresponding guiding arms respectively, said middle portion is rearwardly offset from the two side portions, and an outermost portion of each of said side portions is offset rearwardly from a front end of the corresponding guiding arm.

5. The connector as claimed in claim 4, wherein said middle portion is fallen downwardly relative to the two side portions.

6. The connector as claimed in claim 5, wherein said middle portion defines a bottom surface adapted to be abutted against by an inserted card to deform upwardly.

7. The card connector as claimed in claim 1, wherein the header connector, the reinforcing beam and the two guiding arms are integrally formed and made from insulating material.

* * * * *